US006817337B1

(12) United States Patent
Siring et al.

(10) Patent No.: US 6,817,337 B1
(45) Date of Patent: Nov. 16, 2004

(54) COVER CONNECTOR

(75) Inventors: Andrew J Siring, Ortonville, MI (US); David D Dicks, Oakville (CA); Mathew Brockett, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/761,705

(22) Filed: Jan. 21, 2004

(51) Int. Cl.[7] ..... F02B 77/00; F02F 7/00

(52) U.S. Cl. ..... 123/198 E; 123/195 A; 123/469; 403/122

(58) Field of Search ..... 123/195 A, 198 E, 123/469; 403/122

(56) References Cited

U.S. PATENT DOCUMENTS 4,904,107 A 2/1990 Fukukawa et al.
5,409,320 A 4/1995 Maury et al.
5,615,967 A 4/1997 Hellon
5,743,669 A 4/1998 Fujita et al.
5,876,148 A 3/1999 Kraps
6,206,604 B1 3/2001 Dembowsky et al.

FOREIGN PATENT DOCUMENTS

EP 0902198 3/1999

*Primary Examiner*—Noah P. Kamen
(74) *Attorney, Agent, or Firm*—Thomas A. Jurecko

(57) ABSTRACT

A cover connector has posts which support a cover over an air intake manifold of an automotive vehicle engine, and also support fuel rails and ignited cable separator clips. Each post has a screw on the lower end adapted to thread into an anchorage of the air intake manifold, a clamping flange to clamp a mounting tab on one of the fuel rails down on the anchorage, a support flange to support an end of one of the cable separator clips, and a retainer to hold the end of the cable clip down on the support flange.

10 Claims, 5 Drawing Sheets

COVER CONNECTOR

FIELD OF THE INVENTION

This invention relates generally to a cover connector for supporting a cover over an air intake manifold of an automotive vehicle engine, and more particularly to a cover connector adapted to support additional vehicle engine components.

BACKGROUND OF THE INVENTION

A typical automotive vehicle engine may have two rows of cylinders, a fuel rail for each row of cylinders, spark plugs for the cylinders in one row paired with spark plugs in the other row, an air intake manifold between the rows of cylinders, a cover for the air intake manifold, spark ignition cables connecting the paired spark plugs, and a clip for separating the spark ignition cables. The fuel rails, the cover, the ignition cables and the cable separator clips need to be supported in a simple, efficient and economical manner, but past attempts to accomplish this end have been difficult to achieve.

SUMMARY OF THE INVENTION

In accordance with the present invention, a cover connector is provided which, in addition to supporting the cover, also supports the fuel rails and the ignition cable separator clips. More particularly, the cover connector comprises a plurality of posts, each of which has a fastener element on the lower end attachable to an anchorage on the air intake manifold, a clamping flange above the fastener element for clamping a mounting tab on one of the fuel rails down on the anchorage, a support flange above the clamping flange for supporting one of the cable clips, a retainer for holding the cable clip down on the mounting flange, and a cover supporting element on the upper end.

One object of this invention is to provide a cover connector having the foregoing features and capabilities.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application or uses.

Referring now more particularly to the drawings, there is shown an internal combustion engine E having a row of cylinders 1, 2, 3 and 4, and a row of cylinders 5, 6, 7 and 8. The two rows of cylinders are separated by an air intake manifold 10. A cover 12 is supported above the air intake manifold 10.

Figure 3:
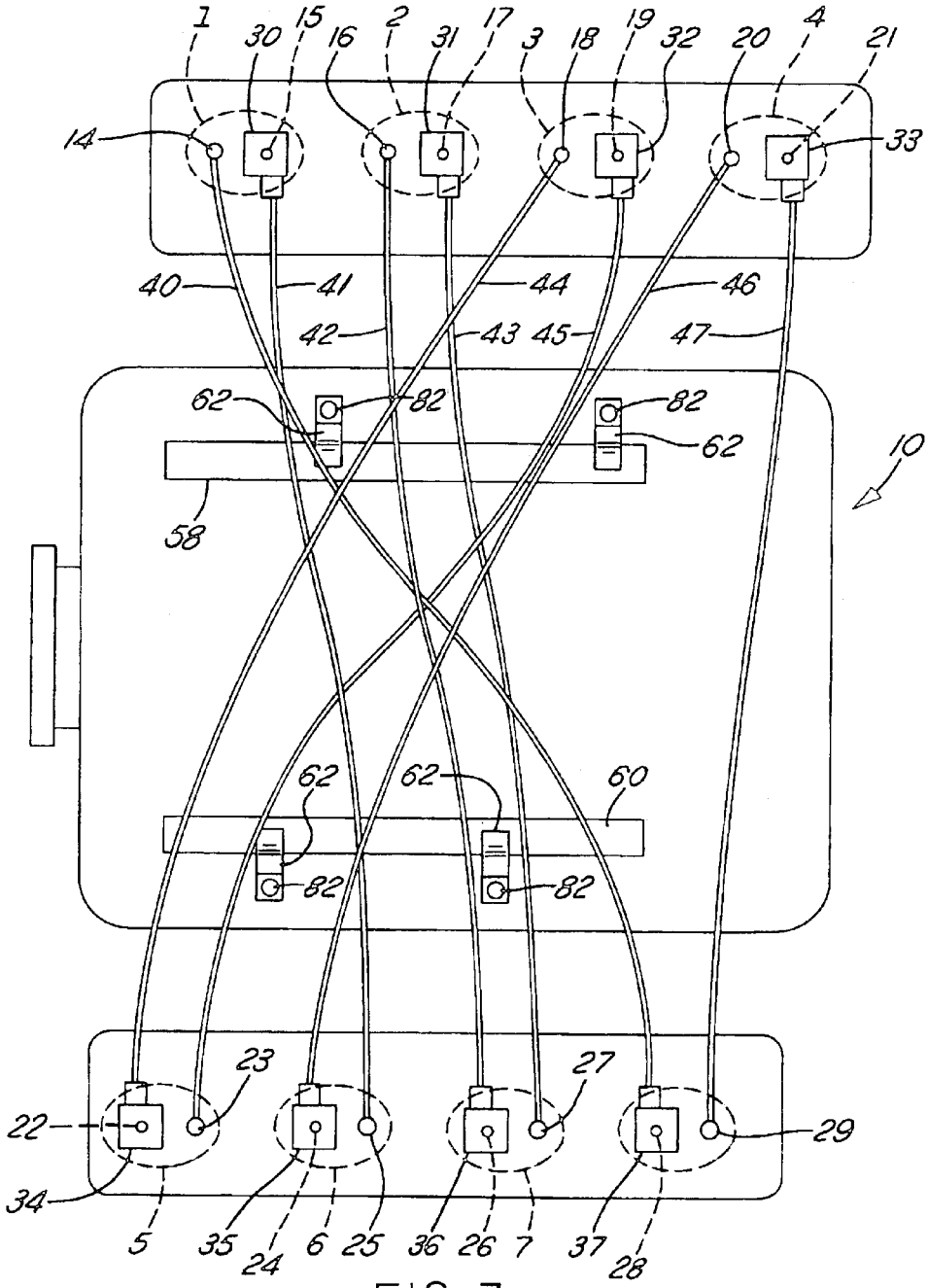
FIG. 3 is a diagrammatic view showing the spark ignition cables extending across the air intake manifold from the spark plugs and coils for the cylinders on one side of the air intake manifold to those on the other side thereof, with the cover and separator clips removed.

Each cylinder has two spark plugs, which are numbered 14, 15, 16, 17, 18, 19, 20, 21, 22, 23, 24, 25, 26, 27, 28 and 29 (see FIG. 3). Associated with one of the spark plugs of each cylinder are coils 30, 31, 32, 33, 34, 35, 36 and 37. The coils receive a signal from a computer that activates the spark plugs. Each coil is responsible for two spark plugs, but not both spark plugs at the same cylinder. Thus, for example, the coil of cylinder 1 activates one spark plug of cylinder 1 and one spark plug of cylinder 6. Spark ignition cables 40, 41, 42, 43, 44, 45, 46 and 47 extend across the air intake manifold 10 in the space between the air intake manifold and the cover 12. Each cable connects a coil of one cylinder on one side of the air intake manifold to a spark plug of a cylinder on the other side.

Figure 1:
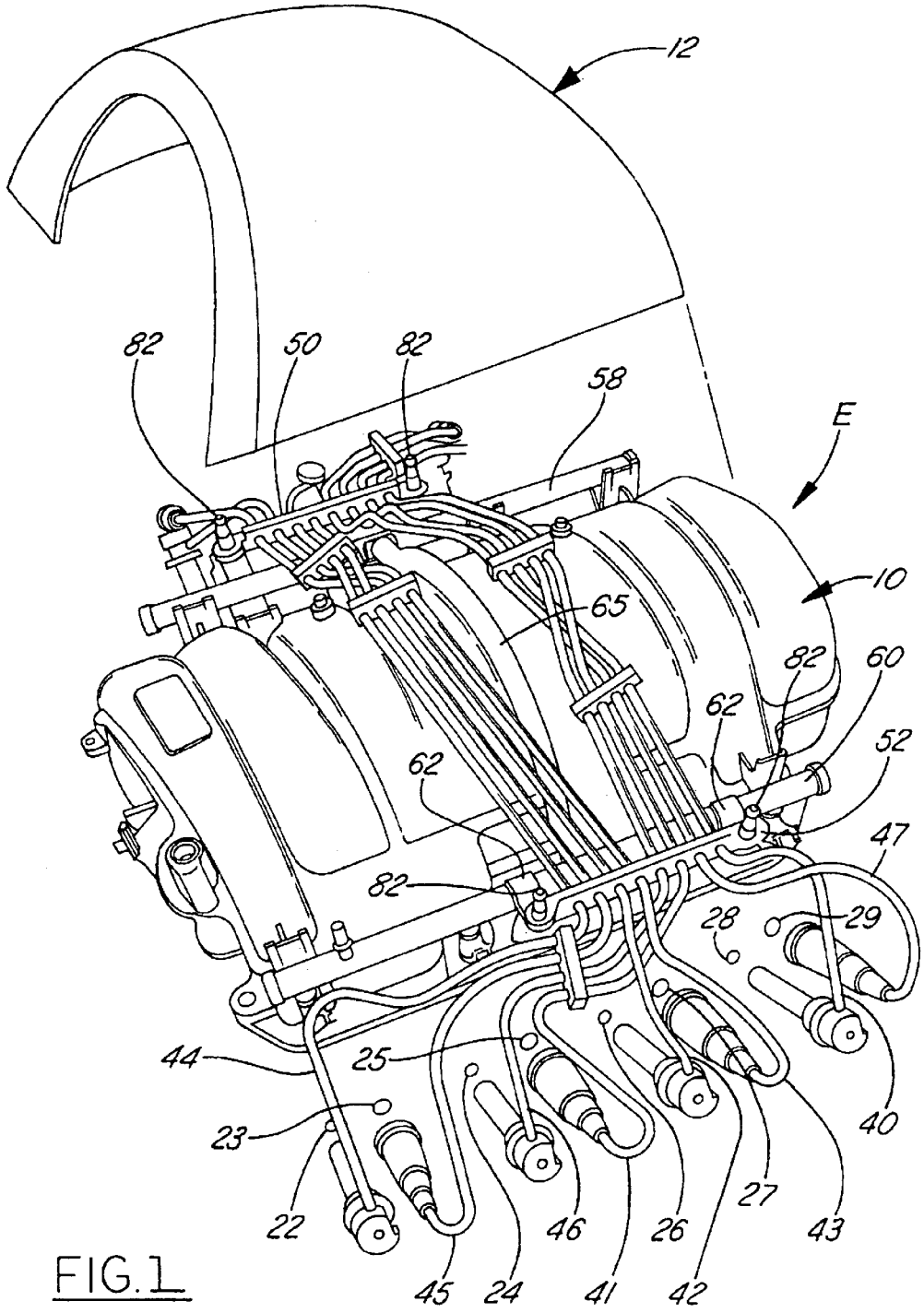
FIG. 1 is a perspective view of portions of an internal combustion engine according to the invention, including an air intake manifold, fuel rails, spark ignition cables, cable separator clips, and a cover for the air intake manifold, with the cover shown separated from the rest of the structure.
Figure 2:
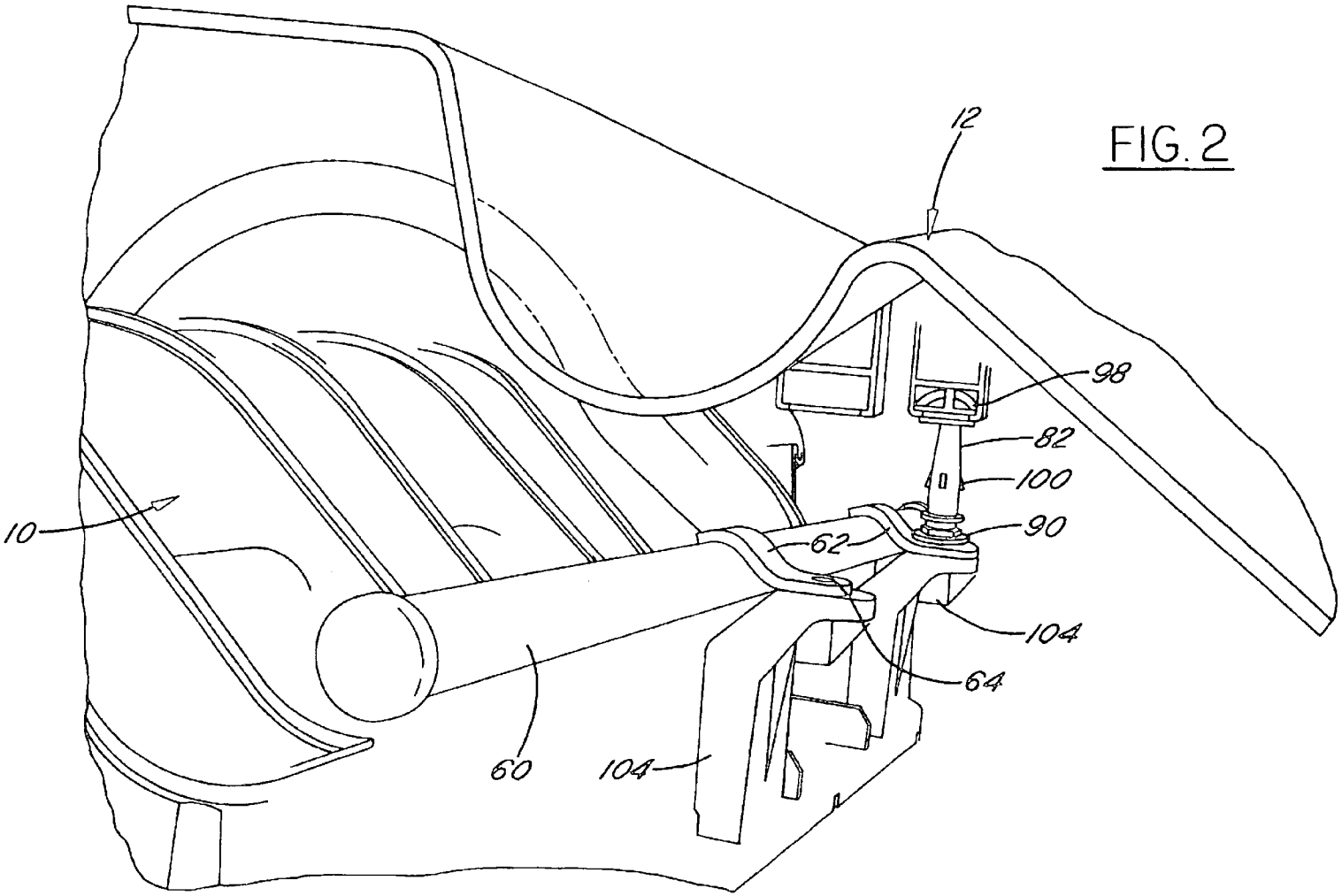
FIG. 2 is an enlarged perspective view of a portion of the structure in FIG. 1.
Figure 4:
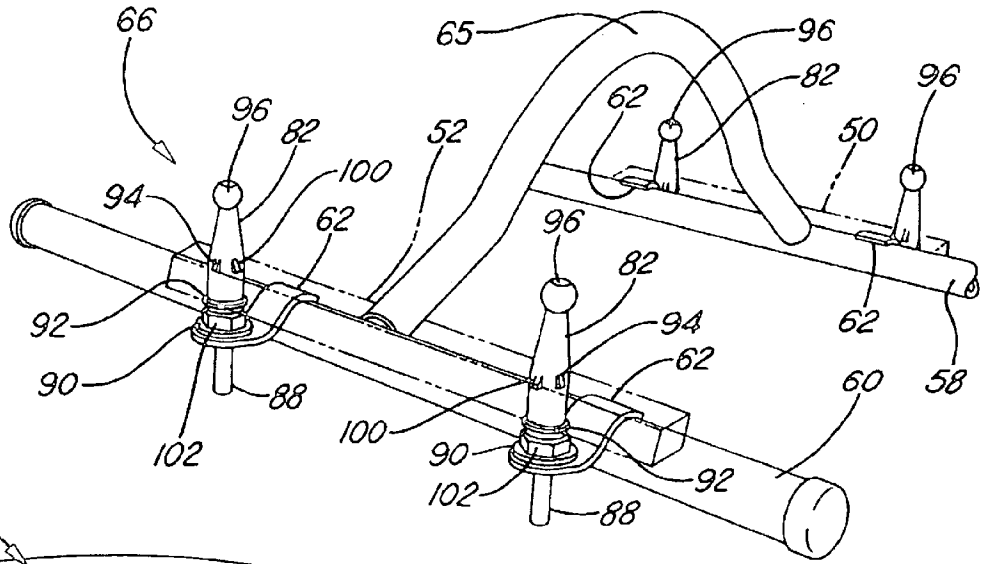
FIG. 4 is a perspective showing the fuel rails, and the cover connector posts, and showing the cable separator clips in broken lines.
Figure 5:
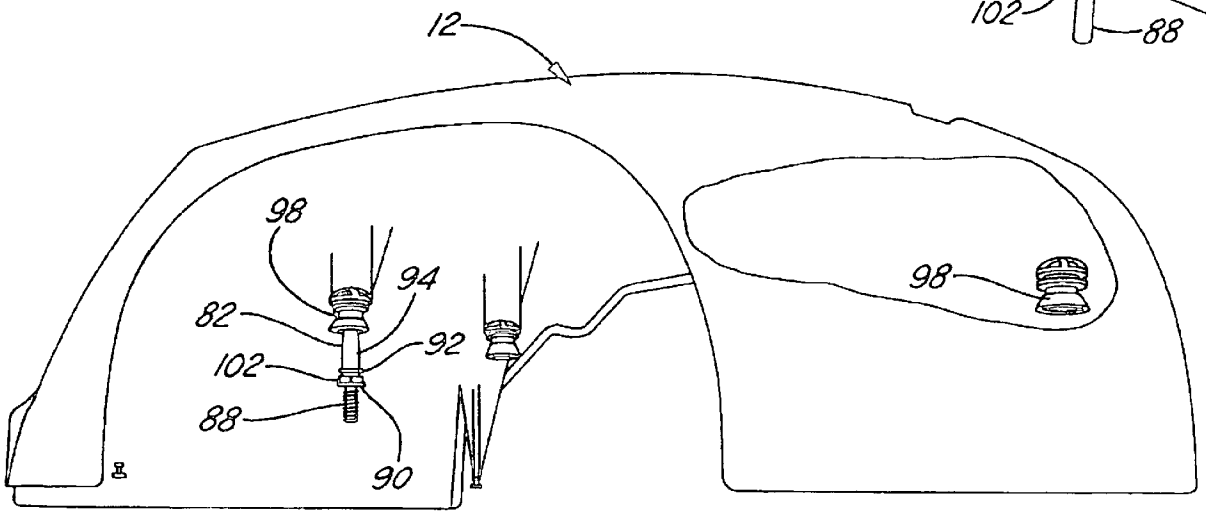
FIG. 5 is a perspective view of the cover.
Figure 6:
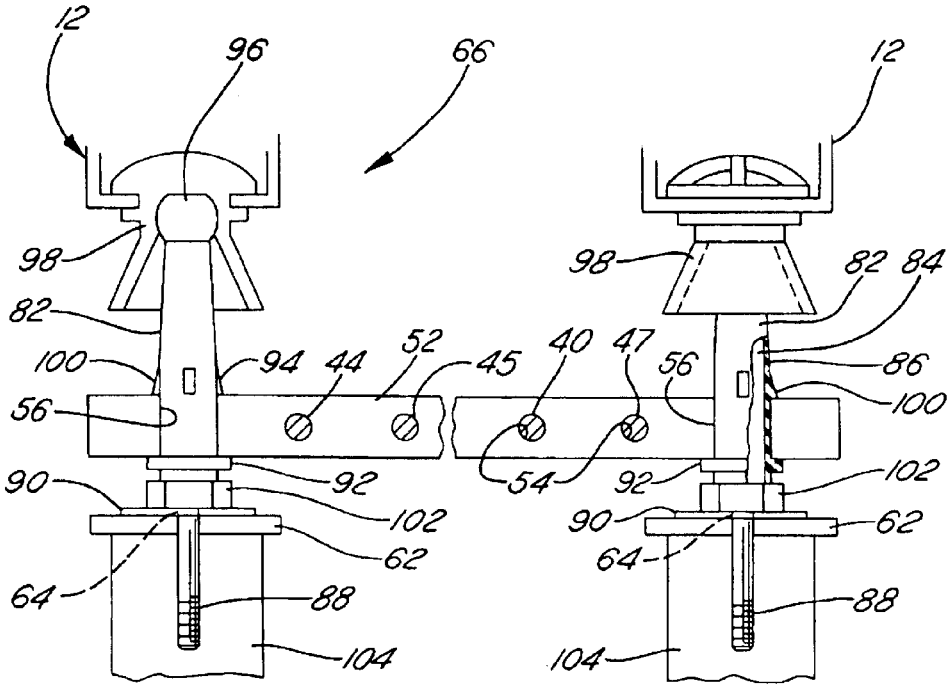
FIG. 6 is a view showing the cover connector posts, one of the cable separator clips, and sockets on the cover engaged over the cover connector posts.

An elongated cable separator clip 50 is provided to separate the cables near the spark plugs and coils on one side of the air intake manifold 10. A similar elongated separator clip 52 is provided to separate the cables near the spark plugs and coils on the other side of the air intake manifold 10. The clips 50 and 52 are not shown in FIG. 3, but one or both clips are shown in FIGS. 1, 4 and 6.

The cables are spaced apart by extending through spaced holes 54 in each of the separator clips 50 and 52. Each of the separator clips 50, 52 has an aperture 56 at each end.

A fuel rail 58 extends along one side of the air intake manifold 10 and delivers fuel to the cylinders 14. A fuel rail 60 extends along the other side of the air intake manifold 10 and delivers fuel to the cylinders 5–8. The fuel rails 58 and 60 each have mounting tabs 62 secured thereto and each mounting tab is provided with an aperture 64. The fuel rails are connected by a cross bar 65.

A cover connector 66 is provided to support the cover 12 over the air intake manifold 10. The cover connector 66 comprises a plurality of elongated vertical posts 82, with preferably two such posts on each side of the air intake manifold 10.

Each post 82 is of integral, one-piece construction, having a body 84 preferably made of a metal such as steel, and a skin 86 of a suitable compressible plastic material covering the body. Each post 82 has an integral fastener element, preferably a screw 88, on the lower end, an integral clamping flange 90 above the screw, an integral cable support flange 92 spaced above the clamping flange 90, a retainer 94 spaced above the mounting flange 92, and an integral ball-shaped element 96 at the upper end. The cover 12 has sockets 98 adapted to receive and hold on to the ball-shaped elements 96. The retainer 94 comprises circumferentially spaced, radially outwardly extending, compressible projections 100. Each post 82 also has an integral nut 102 preferably hex-shaped shaped with opposing flats, between the flanges 90 and 92.

To attach the cover 12, fuel rails 58 and 60, and cable separator clips 50 and 52 to the posts 82, the screw 88 of each post 82 is extended downward through the aperture 64 in a mounting tab 62 of a fuel rail 58 or 60 and the post is rotated by a tool applied to the nut 102 to cause the screw to thread into a rigid anchorage 104 of the air intake manifold 10. Tightening the screw causes the clamping flange 90 on the post to clamp the mounting tab 62 down on the anchorage 104. Each cable separator clip 50, 52 with the cables extending through the holes 54 thereof, is fitted over the tops of two adjacent posts 82 with the posts extending through the apertures 56 in the ends of the separator clip. The ends of the seperator clip compress and pass over the retainer projections 100 to be supported on the support flange 92. The projections 100 hold the ends of the separator clip down on the support flange. The cover 12 is placed over the air intake manifold and the sockets 98 pressed down on the ball-shaped elements 96 on the posts.

The posts 82 thus support not only the cover 12, but also the fuel rails 58 and 60, and the cable separator clips 50, 52.

The description of the invention is merely exemplary in nature, and, thus variations that do not depart from the gist of the invention are intended to be within the scope of the invention. Such variations are not to be regarded as a departure from the spirit and scope of the invention.

What is claimed is:

1. A connector for use in an internal combustion engine, the internal combustion engine having an air intake manifold, a cover over the air intake manifold, a fuel rail for supplying fuel to the engine having a mounting tab, spark ignition cables, and a cable separator clip for separating the cables, said connector comprising:

an elongated connector post;

said post having a lower end provided with a fastener element attachable to an anchorage on the air intake manifold, said post having a clamping flange above said fastener element adapted to clamp the mounting tab of the fuel rail down on the anchorage of the air intake manifold;

said post having a cable clip support flange above said clamping flange for supporting the cable clip, said post having a retainer for holding the cable clip down on the support flange, and said post having an upper end provided with a support element for supporting the cover.

2. The connector of claim 1, wherein said fastener element comprises a screw, and said post has a nut formation between said flanges provided with opposing flats adapted to be engaged by a tool for rotating said post to advance or retract said screw.

3. The connector of claim 1, wherein said retainer comprises radially outwardly extending compressible projections.

4. The connector of claim 1, wherein said support element is ball-shaped and adapted to engage a socket on the cover.

5. The connector of claim 2, wherein said post comprises a metal body covered with a plastic skin, said retainer comprises radially outwardly extending compressible projections on said skin, and said support element is ball-shaped and adapted to engage a socket on the cover.

6. In an internal combustion engine:

an air intake manifold, a cover spaced above the air intake manifold, a fuel rail for supplying fuel to the engine having apertured mounting tabs, spark ignition cables extending between the air intake manifold and the cover, an elongated cable separator clip for separating the cables and having apertured ends, and a connector supporting said cover, said fuel rail and said cable separator clip, said connector including at least two posts each having a lower end provided with a fastener element releasably secured to an anchorage on said air intake manifold, said posts receiving the respective apertured mounting tabs and each having a clamping flange above the fastener element thereof, said clamping flanges clamping the respective mounting tabs down on the anchorage of the air intake manifold, said posts each having a cable separator clip support flange above said clamping flange, said posts receiving the respective apertured ends of said cable separator clip and each having a cable clip support flange above the clamping flange thereof, said support flanges supporting the respective apertured ends of said cable separator clip, said posts each having a retainer above the support flange thereof, said retainers holding the respective apertured ends of said cable separator clip down on said support flanges, and said posts each having an upper end provided with a support element supporting said cover.

7. In the internal combustion engine of claim 6, wherein said fastener element of each of said posts comprises a screw, and said posts each having a nut formation between the flanges thereof provided with opposing flats adapted to be engaged by a tool for rotating said posts to advance or retract said screws.

8. In the internal combustion engine of claim 6, wherein said retainers each comprise circumferentially spaced, radially outwardly extending compressible projections.

9. In the internal combustion engine of claim 6, wherein the support element of each of said posts is ball-shaped, said ball-shaped support elements engaging in sockets of the cover.

10. In the internal combustion engine of claim 7, wherein each of said posts comprises a metal body covered with a plastic skin, the retainer of each of said posts comprises circumferentially spaced, radially outward projections on the skin thereof, and said support elements of each of said posts is ball-shaped, said ball-shaped support elements engaging sockets on said cover.

* * * * *